US006904989B2

(12) United States Patent
Hefter

(10) Patent No.: US 6,904,989 B2
(45) Date of Patent: Jun. 14, 2005

(54) DRIVABLE WAGON, IN PARTICULAR A PROCESSING OR FLOOR CLEANING MACHINE

(75) Inventor: Christian Hefter, Prien am Chiemsaa (DE)

(73) Assignee: Georg Hefter Maschinenbau, Prien am Chiemsee (DE)

( * ) Notice: Subject to any disclaimer, the term of this patent is extended or adjusted under 35 U.S.C. 154(b) by 156 days.

(21) Appl. No.: 10/149,084

(22) PCT Filed: Dec. 7, 2000

(86) PCT No.: PCT/EP00/12353

§ 371 (c)(1),
(2), (4) Date: Jun. 10, 2002

(87) PCT Pub. No.: WO01/41621

PCT Pub. Date: Jun. 14, 2001

(65) Prior Publication Data

US 2002/0183908 A1 Dec. 5, 2002

(30) Foreign Application Priority Data

Dec. 9, 1999 (DE) ..... 199 59 440

(51) Int. Cl.[7] ..... B60T 7/16
(52) U.S. Cl. ..... 180/167; 15/320; 15/49.1
(58) Field of Search ..... 180/167, 168, 180/169; 15/49.1, 320, 87, 98, 319, 340.2; 701/25, 26, 27, 93, 98

(56) References Cited

U.S. PATENT DOCUMENTS 4,674,142 A * 6/1987 Meili ..... 15/49.1
4,700,427 A * 10/1987 Knepper ..... 15/319
4,783,872 A * 11/1988 Burhoe ..... 15/98
4,958,068 A * 9/1990 Pong et al. ..... 180/167
4,962,453 A * 10/1990 Pong et al. ..... 180/167
4,968,878 A * 11/1990 Pong et al. ..... 180/168
5,086,535 A * 2/1992 Grossmeyer et al. ..... 15/319
5,309,592 A * 5/1994 Hiratsuka ..... 15/49.1
5,411,716 A * 5/1995 Thomas et al. ..... 422/264
5,505,915 A * 4/1996 Copeland et al. ..... 422/264
5,605,493 A * 2/1997 Donatelli et al. ..... 15/49.1
5,613,261 A * 3/1997 Kawakami et al. ..... 15/98
5,703,297 A * 12/1997 Bauer ..... 73/756
5,715,567 A * 2/1998 Tagliaferri ..... 15/340.3
5,720,077 A 2/1998 Nakamura et al.
5,867,800 A 2/1999 Leif
6,088,873 A * 7/2000 Pacchini et al. ..... 15/320
6,163,915 A * 12/2000 Kaczmarz et al. ..... 15/49.1
6,338,013 B1 * 1/2002 Ruffner ..... 180/167
6,480,768 B1 * 11/2002 Torii ..... 180/167

FOREIGN PATENT DOCUMENTS

DE 196 15 712 A 12/1997
WO 98 43527 A 10/1998

* cited by examiner

*Primary Examiner*—Hau Phan
(74) *Attorney, Agent, or Firm*—Nixon & Vanderhye P.C.

(57) ABSTRACT

An improved drivable wagon is embodied as a processing or a cleaning device which is suitable in particular for independent driving by the provision of at least one sensor device. The device can be at least swung in unison with at least one steerable running wheel and/or a swingable floor processing or cleaning unit or head.

16 Claims, 4 Drawing Sheets

DRIVABLE WAGON, IN PARTICULAR A PROCESSING OR FLOOR CLEANING MACHINE

This application is the US national phase of international application PCT/GB00/12353 filed 7, Dec. 2000, which designated the US.

BACKGROUND OF THE INVENTION

The invention relates to a mobile carriage, in particular embodied as a processing or a cleaning device which is suitable in particular for independent driving by the provision of at least one sensor device.

Cleaning machines are known to a sufficient extent, for example, from international PCT application WO 98/43527 which was published before the priority date, on Oct. 8, 1998.

The actual devices and components used for the floor cleaning in this case may comprise a bristle-containing roller or, for example, two interacting bristle-containing rollers, rotating about a horizontal axis, a circulating brush belt or, for example, one or more interacting brush disks, rotating about at least more or less vertical axes, or combinations of the above devices or the like.

Also already disclosed are self-propelling processing machines and cleaning apparatuses which have corresponding sensor devices. Such sensor devices may comprise, for example, optical sensor devices using a laser beam for sensing purposes (for example in the horizontal plane) and/or ultrasonic sensors, radar sensors, or the like. In particular nowadays, use can even be made of sensors based on a camera with a silicon chip for evaluating the recorded image.

In order for it to be possible to achieve corresponding good sensing of the surroundings and in respect of any existing obstacles, it has already been proposed to fit a total of 96 sensors in a wide range of different locations on a previously known processing machine.

SUMMARY OF THE INVENTION

The object of the present invention is thus to provide an improved sensor system which operates efficiently and effectively and is also of cost-effective construction.

The carriage, which is preferably comparable with a robot and is preferably automatic, in particular in the form of a processing or cleaning machine, is distinguished in that, at least in dependence on the carriage traveling on a curved path or on an actuating, processing or cleaning unit, preferably in the form of a processing or cleaning head, provided on the vehicle pivoting, the at least one sensor device is pivoted along in unison at least in relative terms in the same direction. In a preferred embodiment, the pivoting operation may take place in direct correspondence with the angle deflection of the direction of travel or the rotation of the processing or cleaning head.

This makes it possible to realize the essential advantage that, by virtue of the navigation devices pivoting along in unison, a considerably greater surrounding region may be covered, to be precise always in alignment with the critical region in which a movement takes place. This makes it possible to reduce drastically the number and cost of the sensor devices which are otherwise required.

In a preferred embodiment, at least one sensor device, for example a laser sensor, is provided at floor level, in particular level with the running wheels or slightly above this, for example approximately level with a chassis or base of the processing device or of the cleaning machine. This sensor device may be a laser scanner which operates automatically over a horizontal angle range and senses the surroundings. Although this sensor, for example in the form of a laser scanner, already senses the surroundings over a wide-angle range from left to right (usually symmetrically in relation to the center longitudinal axis) when the carriage is traveling in a straight line, the solution according to the invention provides considerable advantages. The advantage according to the invention is manifested, in particular, when the carriage is traveling on a curved path or with the processing or cleaning head pivoting to a pronounced extent since, according to the invention, in this case the sensor is pivoted along in unison. This means that, from the outset, the sensed sensor field may be of comparatively small configuration and even certain lateral dead angles may be provided since, for example when the carriage is traveling to the left, the monitored and scanned region is then pivoted along in unison to the left, that is to say the lateral zones which otherwise, when the carriage is traveling in a straight line, are dead zones are also covered.

Alternatively or as a supplement, according to the invention, at least one higher-level sensor device is, or preferably more than one higher-level sensor devices are, provided, the latter being arranged, for example, in front of the outer paneling of the automatic carriage or of the cleaning device. This sensor device may have a tree-like or column-like construction, which is coupled to the steering or pivoting device of the steering mechanism and/or of the pivotable processing or cleaning head. With the processing or cleaning head pivoting, it is also possible for this sensor device, i.e. for example the sensor column, to be pivoted along in unison and aligned in the running direction in each case.

In a further modification of the invention, it is also possible, however, for this higher-level sensor device to be arranged beneath an outer paneling of the automatic processing or cleaning machine if at least parts of the covering behind which the critical sensor devices are seated are more or less "transparent" for said sensor device or window through-openings are provided at appropriate locations. The only essential factor is for it to be possible over a sufficient angle range, even beneath such an outer paneling of the processing or cleaning machine, for the corresponding sensor devices to be pivoted along in unison.

The invention is described, in particular, for the case of a preferably self-propelling processing or floor-cleaning machine. It is also possible, however, for the invention to be used equally well for any mobile vehicle, in particular also a self-propelling vehicle. Possible examples of these also include lawnmowers, automatic lawn-sprinkling systems, agricultural machinery, road-cleaning or processing machines, snow plows, etc. There is no restriction to certain mobile vehicles or processing or cleaning machines.

BRIEF DESCRIPTION OF THE DRAWINGS

The invention is explained in more detail hereinbelow with reference to an exemplary embodiment. In the drawings, in specific terms.

DETAILED DESCRIPTION OF THE INVENTION

Figure 1:
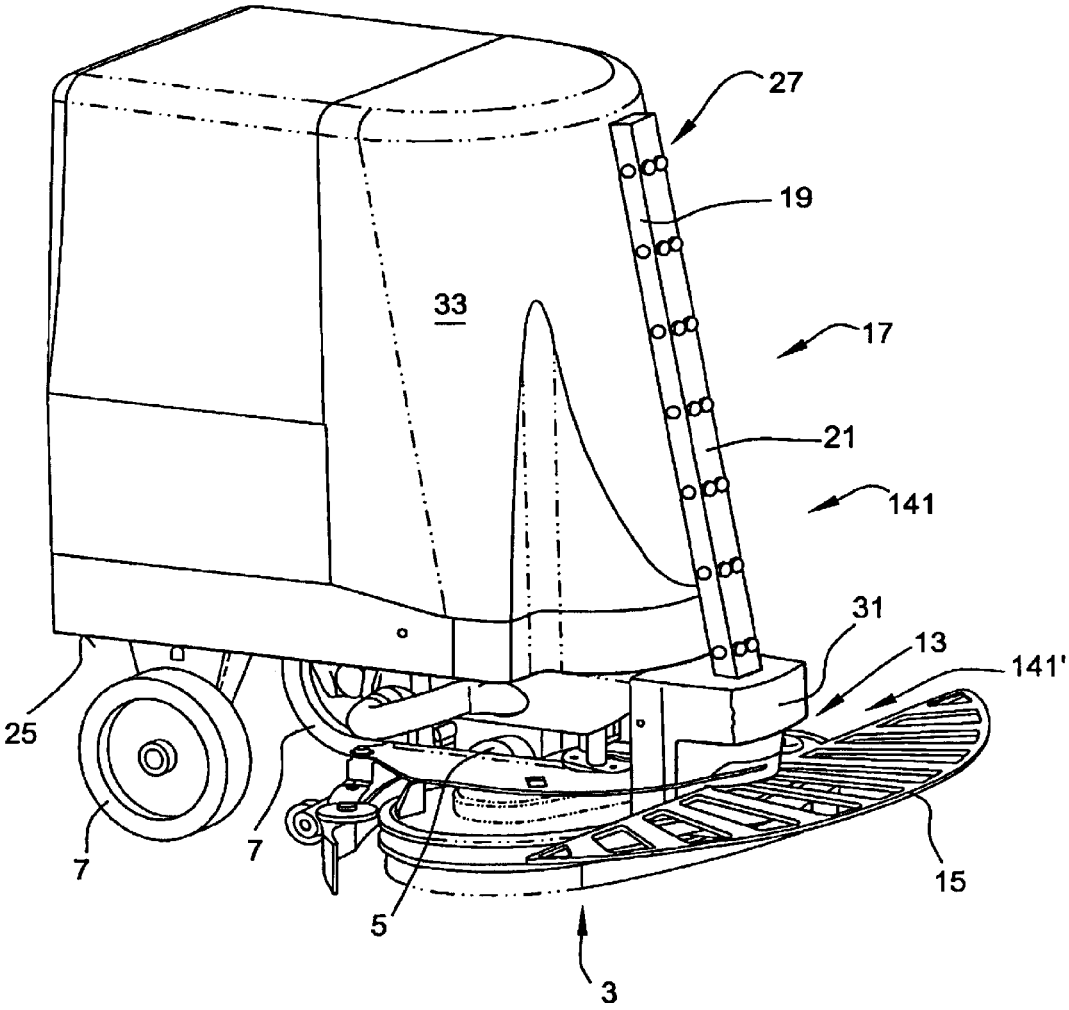
FIG. 1: shows a simplified perspective illustration of a cleaning machine with a sensor device according to the invention which can be pivoted along in unison.
Figure 2:
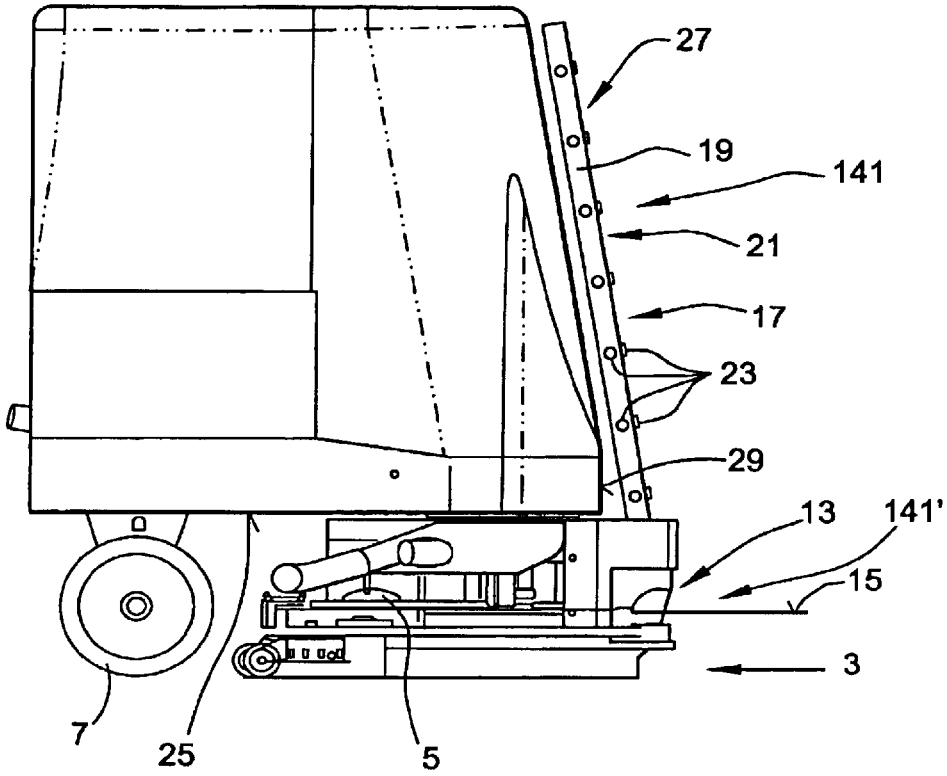
FIG. 2: shows a side view of the exemplary embodiment according to FIG. 1.
Figure 3:
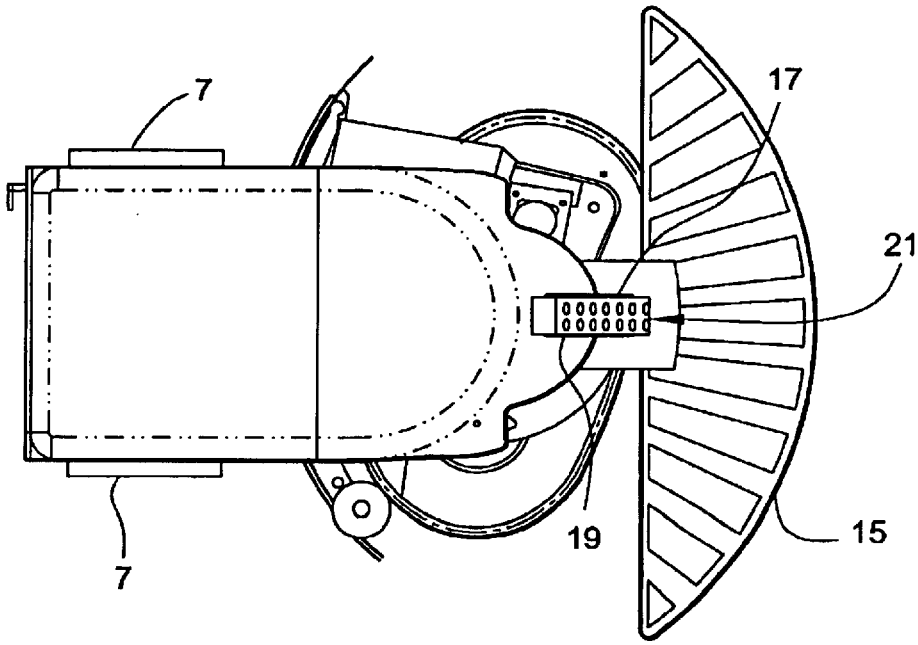
FIG. 3: shows a plan view of the exemplary embodiment according to FIGS. 1 and 2.

FIGS. 1 to 4 show exemplary embodiments of a floor-treating or floor-cleaning machine which, in terms of basic construction, corresponds to the floor-cleaning machine which is known from international PCT application WO 98/43527, which was published before the priority date. The floor-cleaning machine of such a construction has a treating head 3 which can be pivoted about a vertical axis, it further being possible for the cleaning head to be pivoted jointly about the vertical pivoting axis via a running roller 5 which can be pivoted along in unison. The vertical pivoting axis is preferably offset in relation to the vertical diameter through the running roller which can be pivoted along in unison. As far as the construction and functioning of such cleaning machines are concerned, you are referred to the abovementioned prior publication WO 98/43527 in full, and this is included in the contents of the present application. Insofar as the functioning and construction have been described in this prior publication, it is possible to omit such a description here.

In order to configure, for example, a floor-treating machine known from the abovementioned prior publication as an automatic machine, it is possible, then, to provide the corresponding electrics and electronics for moving the floor-treating machine in accordance with a predetermined path or path region.

In practice, however, such an automatic floor-treating machine may only be used expediently if it can react independently to obstacles in the cleaning region. This requires such obstacles to be detected first of all. Such obstacles may be, for example, in the form of people standing in the cleaning region or in the form of objects which, for example, have been newly placed in position, placed at some other location or displaced, etc.

In order always to monitor such obstacles, and/or the boundary of the treating or cleaning surface, automatically and to be able to evaluate the same electronically, the floor-treating machine according to FIGS. 1 to 4 comprises a first, bottom sensor device 13, which may comprise, for example, a laser scanner.

The figures show here, on the one hand, the sensor device 13 as well as an associated sensing field 15, along which the laser beam is moved back and forth permanently and automatically by way of the laser scanner. Within these fields it is possible, within a certain spacing, for the actual sensor 13 to detect, by the evaluation of the reflected light, whether obstacles are located in this region.

It is just as possible, however, to use a different sensor device, for example a sensor based on a radar unit, an infrared unit, ultrasonic sensors, etc. It is also possible, however, to use a camera in order to analyze a corresponding picked-up optical image, by way of possible electronic evaluation methods which are already known nowadays, and to check for the presence of boundaries or obstacles and, in dependence thereon, to change, or at least influence, the continued travel, the travel in a straight line or the travel on a curved path of the automatic cleaning machine.

Also provided is a second sensor device 17, which, in the exemplary embodiment shown, is arranged above the first sensor device 13. The second sensor device comprises a column-like construction with a multiplicity of sensor devices 23, for example in the form of ultrasonic sensor devices 23, formed there and seated, for example, one above the other on the mutually opposite side regions 19 and in the front region 21.

Whilst the first sensor device is preferably arranged directly above the floor region, for example level with the running wheels 5 and 7 or, for example, level with the chassis 25 of the processing or floor-treating machine, the so-called second sensor device 17 is preferably arranged above the chassis 25, that is to say above the floor surface, in the exemplary embodiment shown above the running wheels 7, and extends there, when the carriage is traveling in a straight line, in the center longitudinal plane of symmetry, the plurality of sensors 13, arranged on the front and on the mutually opposite sides 19, being arranged to a more or less pronounced extent vertically one above the other, in the exemplary embodiment shown on a type of sensor column 27.

This sensor column 27 is likewise firmly connected to the treating or cleaning head, in turn, such that it can be pivoted along in unison, in the exemplary embodiment shown it is mounted directly on top of the first sensor device 13, with the result that, when the carriage is correspondingly traveling on a curved path or with the processing or cleaning head 3 pivoting, the first and second sensor devices are automatically aligned in the direction of cleaning and travel.

The overall construction is thus such that, by means of a vertical pivoting axis arranged beneath the chassis 25, the processing or floor-treating head 3 can be pivoted from left to right, it being the case that, when the carriage is traveling in a straight line, said pivoting head projects beyond the front boundary 29 (FIG. 2) and the abovementioned second sensor device 17 is retained and mounted on said projecting sensor-carrying section 31. The arrangement including the front housing covering 33 of the floor-treating machine is such that, even with lateral pivoting, said second sensor device 17, for example in the form of the sensor column 27, is no longer able to collide with the housing covering 33.

Figure 4:
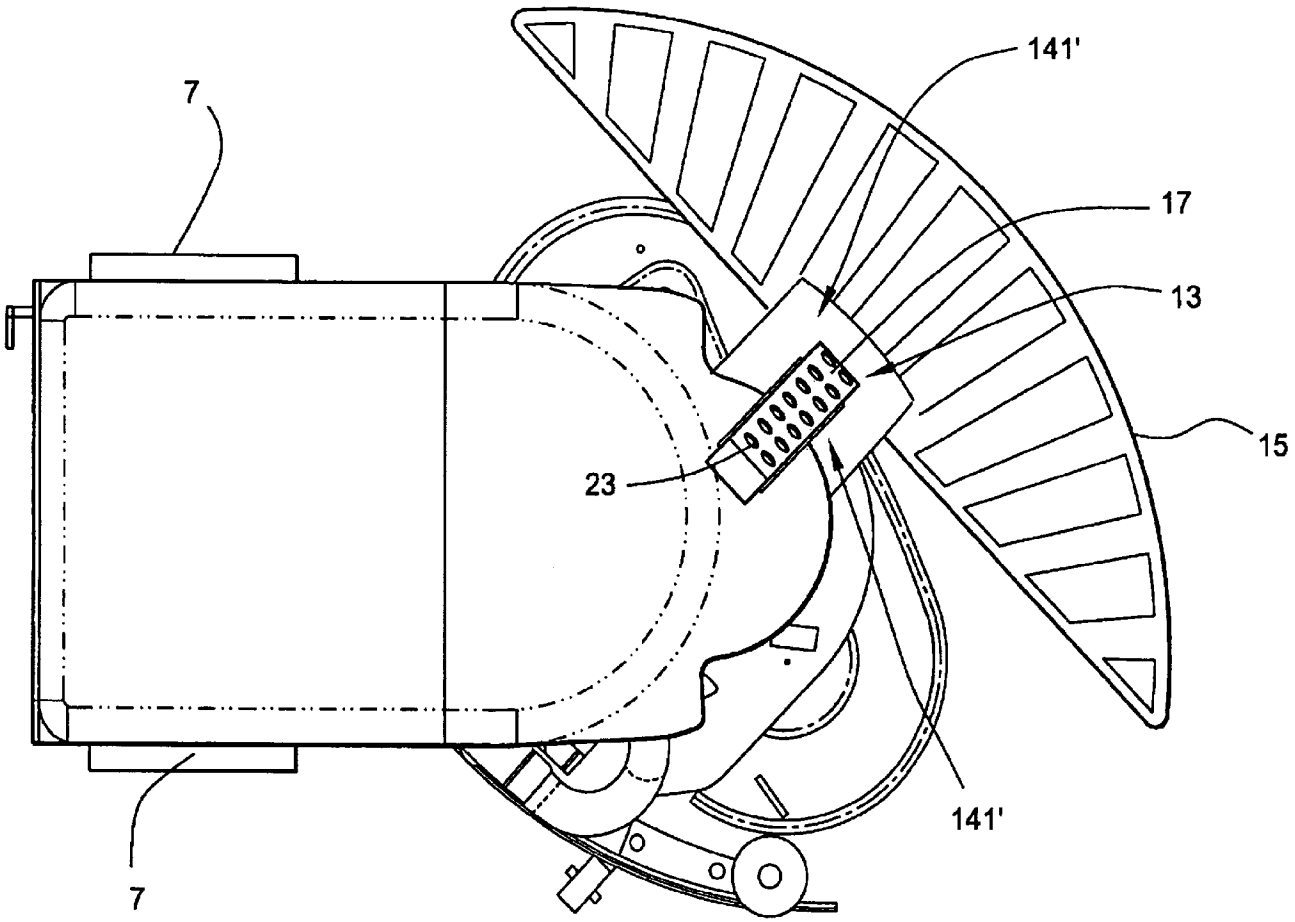
FIG. 4: shows a plan view which corresponds to FIG. 3 but with the carriage traveling on a curved path to the left rather than straight ahead.

In the case of the plan view according to FIG. 4, it is possible to see, in the case of the corresponding pivoting movement to the left, the first sensor device 13 pivoting along in unison, with the corresponding alignment of the sensing field 15, and the second sensor device 17, formed on the sensor column 27, jointly pivoting along in unison.

Since, by virtue of this technical measure, the critical region is always sensed and evaluated, it is possible for the number of individual sensor elements to be drastically reduced in comparison with conventional sensor devices.

Figure 5:
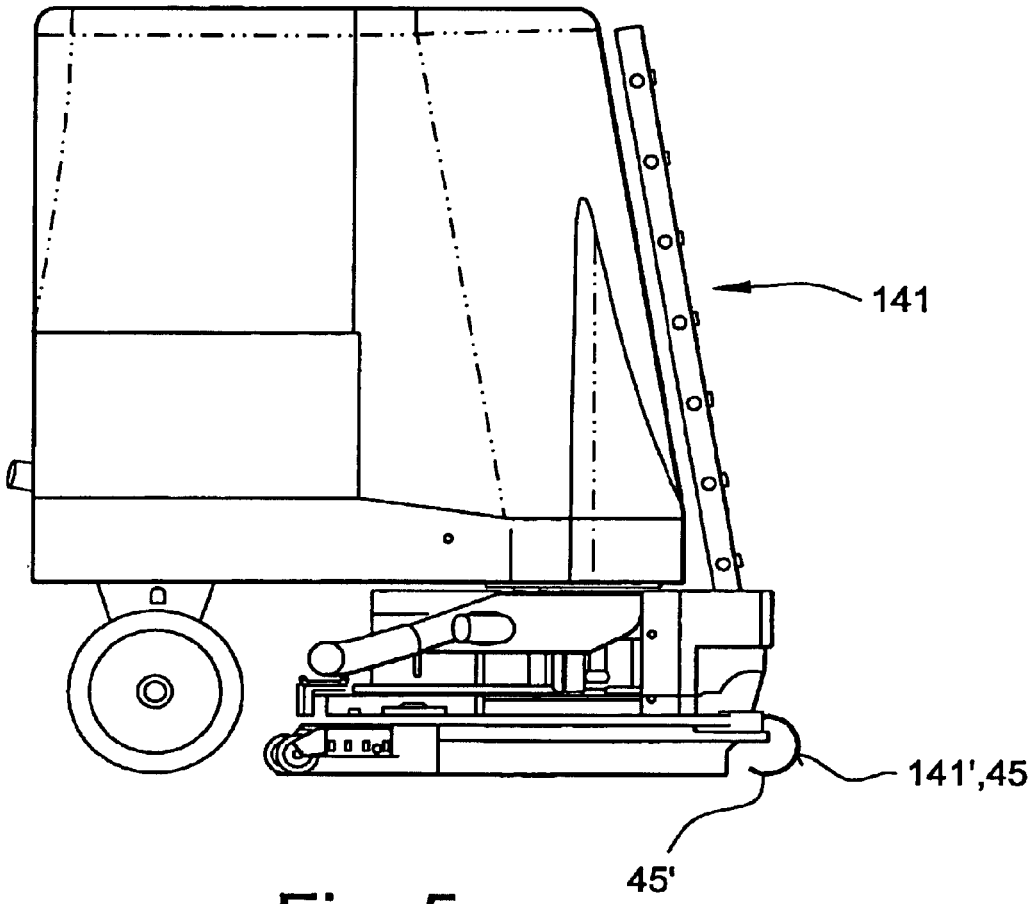
FIG. 5: shows a partly schematic side illustration for the purpose of explaining that the sensor device and the sensor tree may also be designed as a tactile sensor element and/or an additional sensor element, in particular tactile sensor element, may be provided for the purpose of sensing the floor.

FIG. 5 corresponds to the lateral illustration according to FIG. 4. It is further provided in the case of FIG. 5 that the sensor device 13, 17 acts overall as a tactile sensor element 41. In other words, if the mobile carriage, for example in the form of the floor-cleaning machine explained, runs into an object which, for example, also projects above the floor in the direction of the machine, it is possible either for the upwardly projecting sensor tree in the form of the second sensor device 17 or else also for the first, bottom sensor device 13—as a result of the fact that the two units are designed together or separately as tactile sensor devices 41—to initiate a corresponding signal, upon contact with relevant objects, in order to stop further travel in the forward direction and, if required, to move, for example, some way back again and then to the side, in particular when the carriage is a self-propelling vehicle.

Alternatively or as a supplement, it is also possible to provide a further sensor device 141, in particular in the form of a tactile sensor device 141', which, in the exemplary embodiment shown in FIG. 5, comprises a bar-like contact device 45 which projects in the forward and downward directions and is provided at the bottom with a roller or after a contact section 45' tilted down counter to the direction of travel. If the vehicle explained above, for example in the form of a floor-cleaning machine, moves toward downwardly directed stairs, then this floor-sensor device 141, in particular in the form of a tactile sensor device 141, would immediately detect that the floor surface terminates at a step or a drop and would bring the vehicle to a standstill or initiate, if required, a change in direction to the side or to the rear or a correspondingly superposed movement. It is thus possible to prevent the vehicle from tumbling downward, for example, on stairs or ramps.

What is claimed is:

1. A mobile cleaning machine carriage comprising a chassis having at least one running wheel and a pivotable cleaning unit, said pivotable cleaning unit connected to said chassis by means of a vertical pivoting axis, said cleaning unit also including at least one sensor device, said sensor device arranged above a floor region, said sensor device firmly connected to the cleaning unit such that the sensor device is pivotable in unison at least in relative with the at least one running wheel.

2. The mobile cleaning machine as claimed in claim 1, wherein the sensor device is arranged level with at least one of the running wheel and the chassis.

3. The mobile cleaning machine as claimed in claim 1, wherein the sensor device is arranged above at least one of the pivotable wheel and the chassis.

4. A mobile cleaning machine comprising:

a pivotable cleaning unit;

at least one steerable wheel; and a plurality of sensor devices arranged one above the other and laterally in relation to one another, wherein the sensor devices are pivotable in unison with the pivotable cleaning unit and the steerable wheel, and wherein the sensor devices are arranged above the at least one steerable wheel.

5. A mobile carriage having at least one pivotable wheel and a pivotable unit, and having at least one sensor device, the sensor device being pivotable along the same deflection direction in unison at least in relative terms with the at least one pivotable wheel and pivotable unit wherein the sensor device is arranged above at least one of the pivotable wheel and a chassis, and wherein the sensor device comprises a plurality of individual sensors arranged one above the other and laterally in relation to one another.

6. The carriage as claimed in claim 5, wherein the sensor device is arranged level with at least one of the running wheel and a chassis of the mobile carriage.

7. The carriage as claimed in claim 5, wherein when the carriage is traveling in a straight line or with the unit in a non-pivoted state, the plurality of sensors are arranged approximately symmetrically in relation to a vertical center longitudinal axis of the carriage.

8. The carriage as claimed in claim 5, wherein the plurality of sensors are arranged on a column-like carrying element which extends essentially with a vertical component and leads in the direction of travel.

9. The carriage as claimed in claim 8, wherein the sensors comprise ultrasonic sensors.

10. The carriage as claimed in claim 5, wherein the sensor device comprises a bottom sensor device in the form of one of a laser or radar sensor acting in a certain lateral angle range.

11. The carriage as claimed in claim 5, wherein the sensor device comprises at least one tactile sensor device.

12. The carriage as claimed in claim 11, wherein the tactile sensor device is provided with a second sensor device level with at least one of the pivotable wheel and with a third sensor device above the pivotable wheel and above a chassis and is coupled to said second and third sensor devices.

13. The carriage as claimed in claim 5, wherein a specific sensor device is provided for monitoring the floor surface.

14. The carriage as claimed in claim 13, wherein the sensor device for monitoring the floor surface comprises a tactile sensor device.

15. The carriage as claimed in claim 14 wherein the sensor device for monitoring the floor surface acts in a front region of the carriage, in front of a foremost running wheel.

16. The carriage as claimed in claim 15, wherein the tactile sensor device is in contact with the floor surface by way of a contact section.

* * * * *